US009168547B2

(12) United States Patent
Brown et al.

(10) Patent No.: US 9,168,547 B2
(45) Date of Patent: Oct. 27, 2015

(54) THERMAL METAL SPRAYING APPARATUS

(75) Inventors: Theodore Robert Brown, Birmingham, MI (US); John Graham, Clinton Township, MI (US)

(73) Assignee: Comau, Inc., Southfield, MI (US)

( * ) Notice: Subject to any disclaimer, the term of this patent is extended or adjusted under 35 U.S.C. 154(b) by 479 days.

(21) Appl. No.: 13/538,436

(22) Filed: Jun. 29, 2012

(65) Prior Publication Data

US 2013/0000550 A1 Jan. 3, 2013

Related U.S. Application Data

(60) Provisional application No. 61/503,866, filed on Jul. 1, 2011.

(51) Int. Cl.

| | |
|---|---|
| ***B05B 15/04*** | (2006.01) |
| ***B05B 7/20*** | (2006.01) |
| ***B05B 7/16*** | (2006.01) |
| ***B05B 13/06*** | (2006.01) |
| ***B05B 1/28*** | (2006.01) |
| ***B05B 7/22*** | (2006.01) |
| ***C23C 4/00*** | (2006.01) |
| *B05D 1/02* | (2006.01) |
| *C23C 4/12* | (2006.01) |
| *F02F 1/20* | (2006.01) |

(52) U.S. Cl.

CPC . *B05B 7/203* (2013.01); *B05B 1/28* (2013.01); *B05B 7/224* (2013.01); *B05B 13/0636* (2013.01); *B05B 15/045* (2013.01); *B05B 15/0443* (2013.01); *B05B 15/0462* (2013.01); *B05B 15/0493* (2013.01); *C23C 4/00* (2013.01); *C23C 4/12* (2013.01); *B05B 13/069* (2013.01); *B05B 13/0618* (2013.01); *B05D 1/02* (2013.01); *C23C 4/124* (2013.01); *C23C 4/125* (2013.01); *C23C 4/127* (2013.01); *F02F 1/20* (2013.01)

(58) Field of Classification Search

CPC .. B05B 15/045; B05B 15/0462; B05B 7/224; B05B 13/0636; B05B 13/0618; B05D 1/02; C23C 4/124; C23C 4/125; C23C 4/127

USPC ..... 118/504, 715; 427/236, 239, 455; 219/121.47, 121.48

See application file for complete search history.

(56) References Cited

U.S. PATENT DOCUMENTS 5,151,308 A 9/1992 Moskowitz et al.
5,285,967 A * 2/1994 Weidman ..... 239/80

(Continued)

*Primary Examiner* — Dah-Wei D Yuan
*Assistant Examiner* — Binu Thomas
(74) *Attorney, Agent, or Firm* — Young Basile Hanlon & MacFarlane P.C.

(57) ABSTRACT

A thermal metal spraying apparatus for use with a thermal metal spraying torch for applying a metal coating to a workpiece through a torch spraying nozzle having a spraying orifice. The thermal metal spraying apparatus provides a substantially tubular shroud having a first end and a second end adaptable to concentrically receive the torch spraying nozzle. The shroud has an opening at the second end, wherein the opening is selectably alignable with the spraying orifice. A drive mechanism is connected to the shroud and is operable to translate the shroud between a first position, wherein the opening at the second end is not aligned with the spraying orifice, thereby preventing the spraying of the metal coating on the workpiece, and a second position, wherein the opening at the second end is aligned with the spraying orifice permitting the spraying of the metal coating toward the workpiece.

19 Claims, 11 Drawing Sheets

(56) References Cited

U.S. PATENT DOCUMENTS

| | | | | |
|---|---|---|---|---|
| 5,296,667 | A | 3/1994 | Marantz et al. | |
| 5,442,153 | A | 8/1995 | Marantz et al. | |
| 5,468,295 | A | 11/1995 | Marantz et al. | |
| 5,808,270 | A | 9/1998 | Marantz et al. | |
| 5,938,944 | A | 8/1999 | Baughman et al. | |
| 6,372,298 | B1 | 4/2002 | Marantz et al. | |
| 6,706,993 | B1 | 3/2004 | Chancey et al. | |
| 6,769,627 | B2 * | 8/2004 | Carhuff et al. | 239/120 |
| 6,861,101 | B1 | 3/2005 | Kowalsky et al. | |
| 6,986,471 | B1 | 1/2006 | Kowalsky et al. | |
| 7,491,907 | B2 | 2/2009 | Kowalsky et al. | |
| 2002/0022209 | A1 * | 2/2002 | Polino et al. | 432/115 |
| 2002/0033133 | A1 * | 3/2002 | Klein et al. | 118/500 |
| 2002/0043567 | A1 * | 4/2002 | Provenaz et al. | 239/1 |
| 2002/0078887 | A1 * | 6/2002 | Shepley et al. | 118/504 |
| 2004/0231596 | A1 | 11/2004 | George | |
| 2005/0170099 | A1 * | 8/2005 | Gadow et al. | 427/446 |

* cited by examiner

THERMAL METAL SPRAYING APPARATUS

CROSS-REFERENCE TO RELATED APPLICATIONS

The subject application claims the priority of U.S. Provisional Patent Application Ser. No. 61/503,866, filed on Jul. 1, 2011.

TECHNICAL FIELD

The present invention relates to the field of thermal or plasma metal spraying for use in applying thin films and coatings, and in particular, a masking shroud for use with a thermal metal spraying torch that prevents the undesirable application of a metal spray or coating on a workpiece.

BACKGROUND OF THE INVENTION

The plasma transferred wire arc ("PTWA") process is a particularly useful high-pressure plasma coating process capable of producing high-quality metallic coatings for a variety of applications, such as the coating of engine cylinder bores. In the PTWA process, a high-pressure plasma is generated in a small region of space at the exit of a plasma torch. A continuously-fed metallic wire impinges upon this region wherein the wire is melted and atomized by the plasma. High-speed gas emerging from the plasma torch directs the molten metal toward the surface to be coated.

When utilizing the PTWA process, it is difficult to control the spray of the molten metal in industrial applications. Thus, one must protect against undesirable overspray of the molten metal on areas of the workpiece that extend beyond the treated surface. The current process for masking or protecting untreated surfaces on the workpiece include adding a coating spray to the untreated surfaces on the workpiece or by placing a dedicated or hard-tooled cover to fit over and protect the untreated surfaces. Spraying the unprotected surfaces with a coating is impractical on an industrial scale, as the coating must be applied and then removed after the PTWA process. Hard-tooled, dedicated covers are also not practical, as they limit the flexibility associated with automated tooling and machinery. In addition, neither of these processes provide for a highly accurate spray line or boundary between the treated surfaces and the non-treated surfaces of the workpiece.

It would be desirable to create a thermal metal spraying apparatus that properly masks sprayed metal from untreated surfaces of a workpiece without having to utilize supplemental coatings and/or tooling.

SUMMARY OF THE INVENTION

The present invention provides a thermal metal spraying apparatus that masks sprayed metal from the untreated surfaces of a workpiece. The thermal metal spraying apparatus of the present invention is used with a thermal metal spraying torch for applying a metal coating to a workpiece through a torch spraying nozzle having a spraying orifice. A substantially tubular shroud has a first end and a second end and is adaptable to concentrically receive the torch spraying nozzle. The shroud has an opening at the second end, wherein the opening is selectively alignable with the spraying orifice. A drive mechanism is connected to the shroud and is operable to translate the shroud between a first position, wherein the opening is not aligned with the spraying orifice, thereby preventing the spraying of a metal coating toward the workpiece, and a second position, wherein the opening is aligned with the spraying orifice permitting the spraying of the metal coating toward the workpiece. A deflection insert is connected to the second end of the shroud adjacent the opening for deflecting the metal coating away from the workpiece when the shroud is in the first position. The deflection insert may be positioned at an acute angle relative to a longitudinal axis of the shroud.

The shroud has a mechanical spline on an inner diameter of the first end of the shroud. The mechanical spline is connectable to a mating spline on the torch spraying nozzle for providing linear movement of the shroud relative to the torch spraying nozzle along the longitudinal axis of the shroud and preventing rotational movement of the shroud relative to the torch spraying nozzle. The drive mechanism has a motor connectable to the torch spraying nozzle, and a threaded drive shaft extends from the motor. A receiver block may be connected to the first end of the shroud and has a threaded aperture for threadably receiving the drive shaft. The motor drives linear movement of the shroud relative to the torch spraying nozzle along the longitudinal axis of the shroud by rotating the drive shaft.

The present invention may also provide a substantially tubular outer mask for receiving the shroud in a substantially concentric manner. A longitudinal passageway is formed between the outer mask and the shroud. A pressurized air source is in communication with the passageway for selectively directing the metal coating away from the workpiece. An adjustment mechanism may be connected to the outer mask for changing the longitudinal length of the outer mask relative to the shroud. The adjustment mechanism may have a flexible bellows portion connected to the outer mask which contracts and expands to adjust the longitudinal length of the outer mask. The receiver block may be connected to the outer mask, wherein a pair of opposing rollers are rotatably connected to the receiver block to rollably engage the shroud and provide rotational movement of the outer mask relative to the shroud and provide linear movement of the shroud relative to the torch spraying nozzle.

A manipulator may be connected to the shroud and connectable to the torch spraying nozzle for properly positioning the shroud and the torch spraying nozzle relative to the workpiece.

A processing cell may be provided for enclosing the manipulator, the torch spraying nozzle, the shroud, and the workpiece. The processing cell may include a part delivery system having a retractable drawer that moves between an open position, wherein the drawer moves outside the processing cell for loading and unloading the workpiece, and a closed position, wherein the drawer moves inside the cell allowing the metal coating to be sprayed onto the workpiece. The processing cell may also include an automatic tool changing system having a retractable drawer that moves between an open position, wherein the drawer moves outside the cell for loading and unloading at least one alternative metal spraying torch, and a closed position, wherein the drawer moves inside the processing cell allowing the at least one alternative metal spraying torch to be accessed by the manipulator. An automatic tool changer may be connected to the manipulator to engage and disengage the at least one torch spraying nozzle. A vacuum system may be contained within the processing cell for collecting metal spray that does not adhere to the workpiece. The retractable drawer of the part delivery system may have a work holding fixture disposed therein and adaptable for receiving the workpiece such that the metal spray can be applied to the workpiece while the workpiece is disposed within the workpiece holding fixture.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

As illustrated in FIGS. 1-12, the present invention provides a thermal metal spraying apparatus that masks a workpiece from a metal coating spray.

Figure 1:
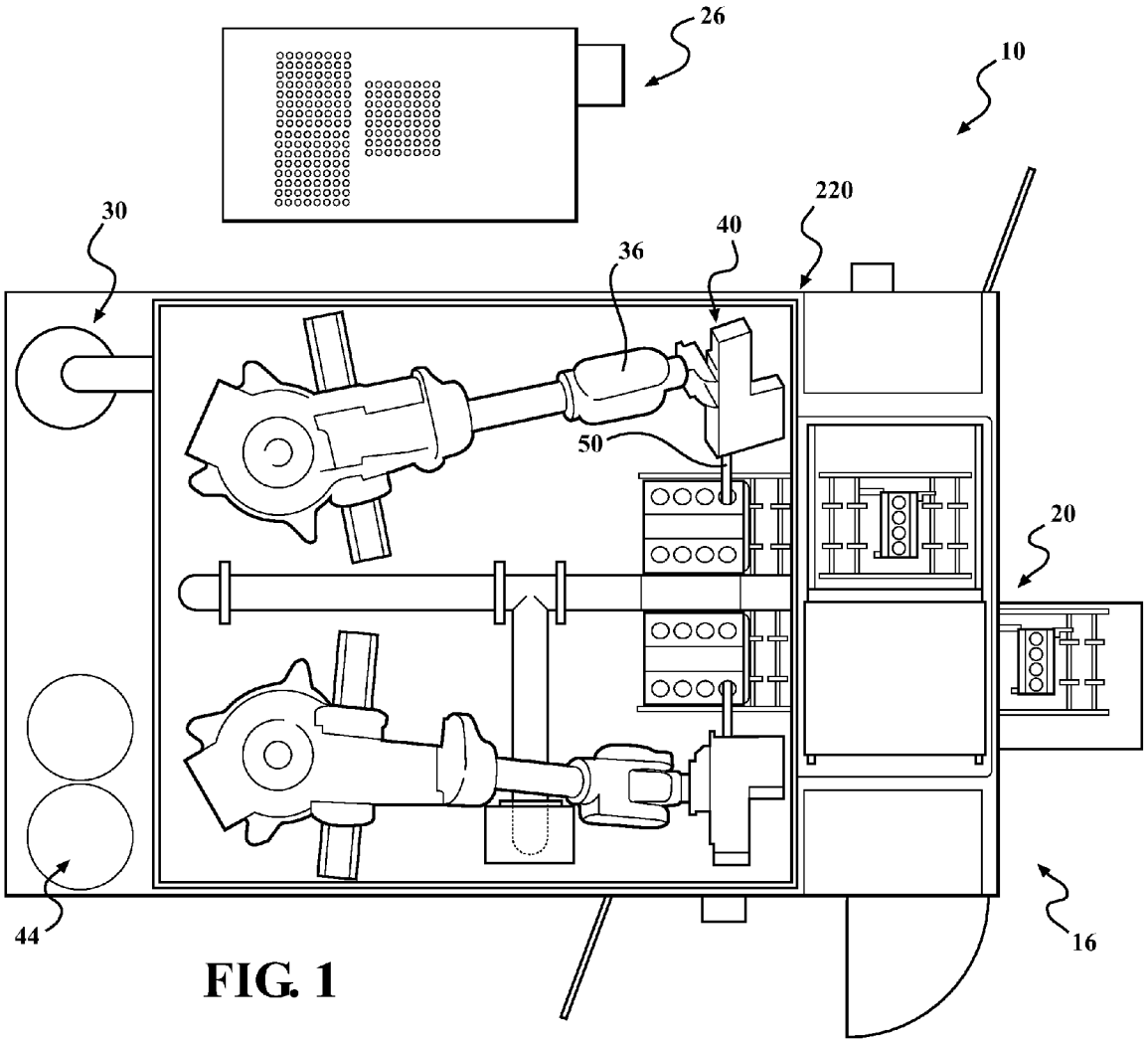
FIG. 1 is a schematic plan view of a processing cell for the thermal metal spraying apparatus of the present invention.
Figure 2:
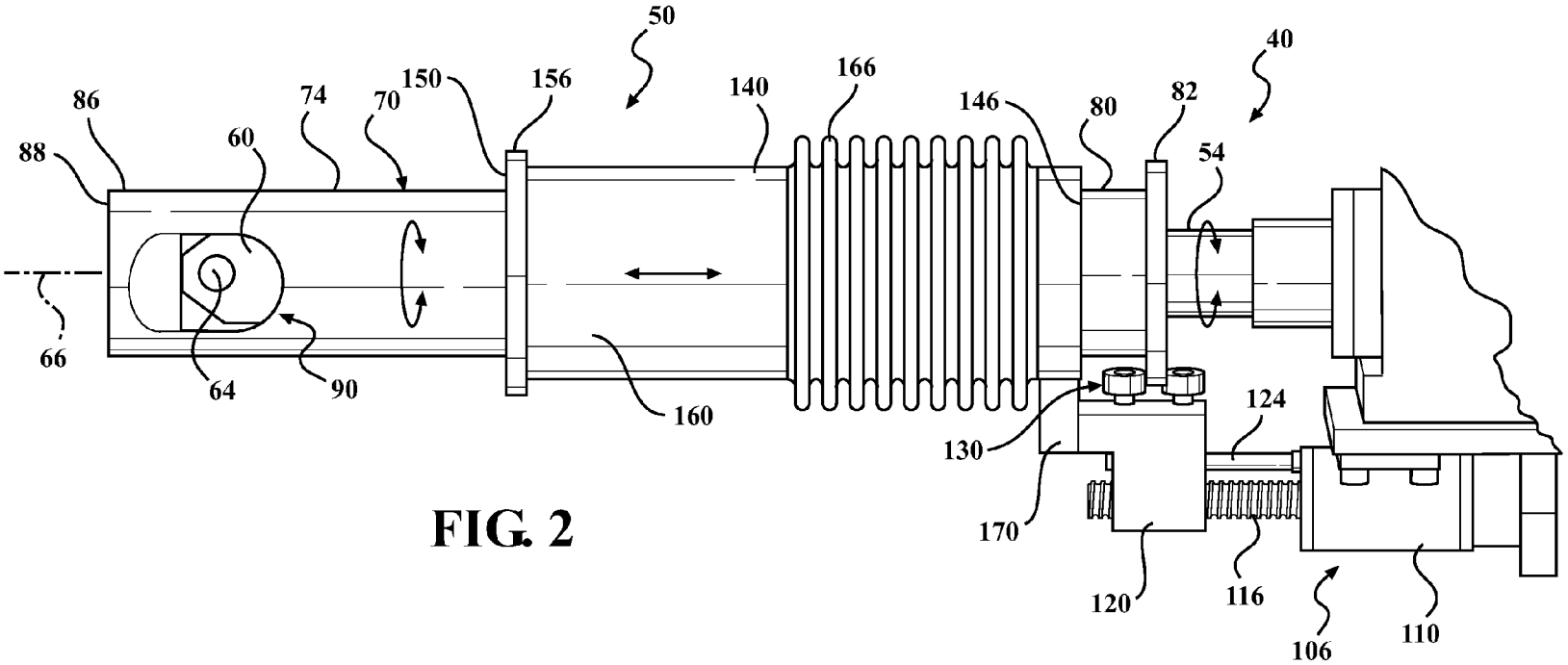
FIG. 2 is a schematic side view of a metal spraying shroud assembly of the thermal metal spraying apparatus of the present invention.

Referring to FIG. 1, a thermal metal spraying apparatus 10 employs a metal spraying shroud assembly 50 as shown. In the example, the apparatus 10 includes a processing cell 16 having a workpiece delivery system 20, a forced air device 26, a particle vacuum system 30, at least one manipulator or multi-axis programmed and controlled industrial robot 36 (two shown), a metal spraying torch assembly 40, and a wire feed system 44. The metal spraying torch assembly 40 is connected to the programmed robot 36 and is selectively movable in all three coordinate directions. The processing cell 16, the metal spraying torch assembly 40, and the metal spraying shroud assembly 50 may be used for coating an internal combustion engine block workpiece 46 with a metal spray 68 and is particularly useful in thermally spraying a thin metal film or coating on the inside of cylindrical piston cylinder bores 48 of the engine block workpiece 46. Other uses, cell structures and layouts known by those skilled in the art may be used. Further, workpieces other than engine block cylinder bores 48, for example, external surfaces, flat surfaces and other surfaces known by those skilled in the art are applicable with the disclosed devices and methods, As seen in FIGS. 2-4, the metal spraying shroud assembly 50 may be used in conjunction with the metal spraying torch assembly 40 as illustrated. In the example and as further explained below, a shroud 70 is installed and positioned concentrically about the metal spraying torch assembly 40 including a torch delivery tube 54 extending from a delivery gun apparatus (not shown) in communication with the wire feed system 44 and pressured gas and electric supply sources (not shown). The metal spraying torch assembly 40 includes a spray nozzle 60 having a spray nozzle orifice 64 which serves to expel high pressure gas heated by the electrical source thereby producing an arc to melt a consumable wire (not shown) to spray the molten metal toward a desired surface of the engine block workpiece 46, such as the inner cylinder bore 48 of the engine block workpiece 46. In one example, the metal spraying torch assembly 40 and the metal spraying shroud assembly 50 rotate about a longitudinal axis 66. Suitable thermal and plasma spraying torches known by those skilled in the art may be used.

Figure 3A:
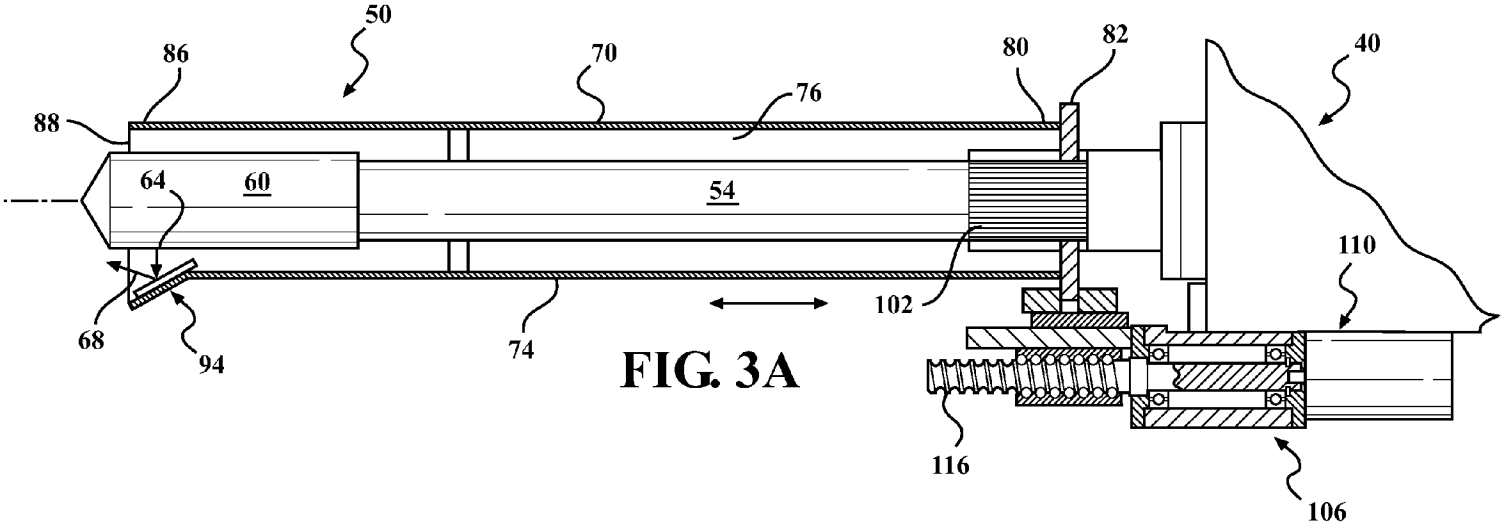
FIG. 3A is a schematic side view of a shroud in a first position of the thermal metal spraying apparatus of the present invention, thereby preventing spraying toward the workpiece.
Figure 3B:
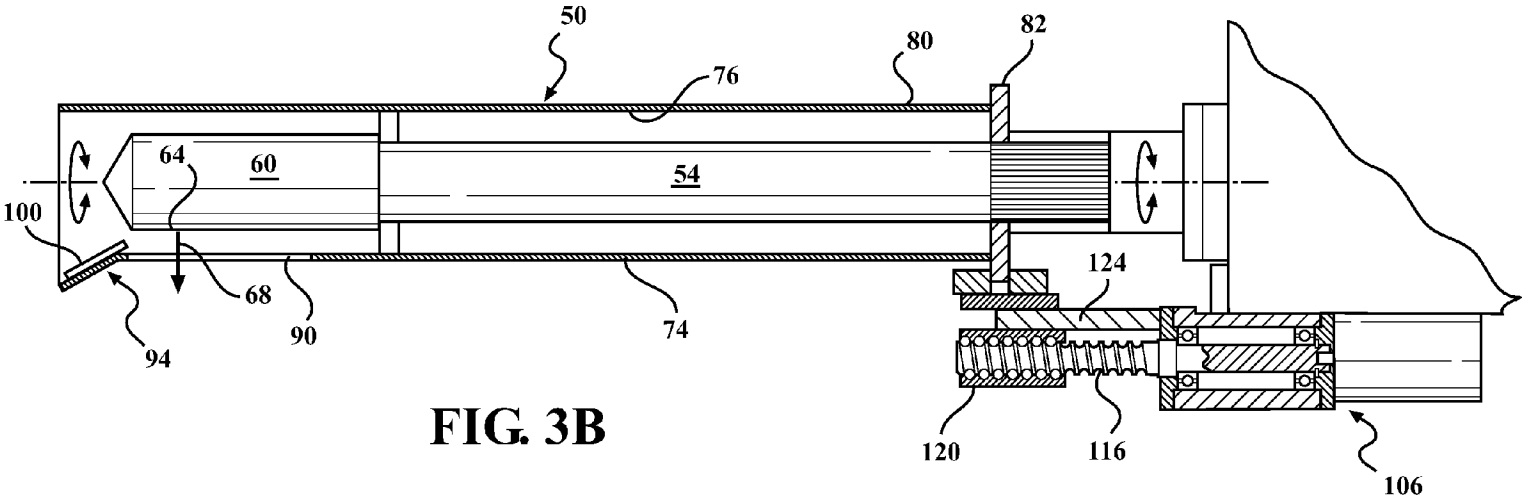
FIG. 3B is a schematic side view of the shroud in a second position of the thermal metal spraying apparatus of the present invention, thereby allowing spraying toward the workpiece.
Figure 4:
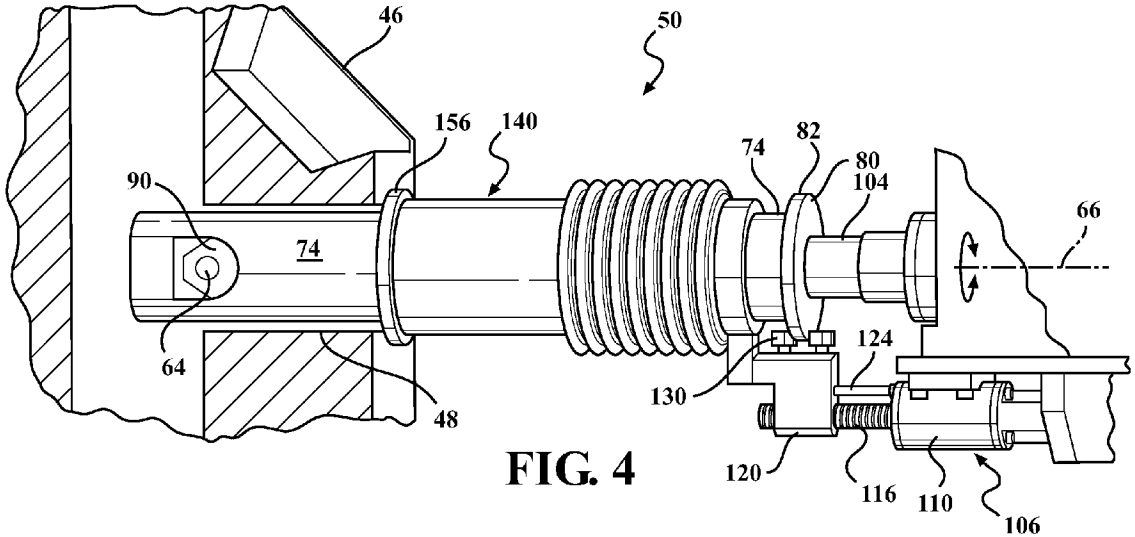
FIG. 4 is a perspective view of the metal spraying shroud assembly of the present invention in the second position and the metal spraying torch assembly positioned inside a workpiece.

As best seen in FIGS. 3A and 3B, the metal spraying shroud assembly 50 includes the shroud 70 having an elongated tubular-configured body 74 defining an internal cavity 76 for housing the torch delivery tube 54 and the spray nozzle 60. In the example and as explained further below, the shroud 70 is connected to and positioned to allow relative linear movement of the shroud 70 relative to the torch delivery tube 54 and the spray nozzle 60 along the longitudinal axis 66. The shroud 70 includes a first end 80 having a radially extending annular flange 82 and a second end 86 defining a through opening 88 positioned distant from the first end 80 along the longitudinal axis 66.

In the example, the shroud 70 defines a spray through an opening 90 positioned toward the second end 86 of the shroud 70, as best seen in FIGS. 2-4. The shroud 70 further includes a spray deflector 94 having an angularly positioned replaceable deflection insert 100 positioned between the spray opening 90 and the second end 86 of the shroud 70, as generally shown. The shroud 70 may be fabricated from a non-ferrous metal such as aluminum. Other materials such as ferrous metals, polymers, elastomers and composites known by those skilled in the art may be used.

As best seen in FIGS. 3 and 4, the shroud 70 is rigidly, but removably, connected to the torch delivery tube 54 through a mechanical spline 102 having a longitudinally extending key 104 and a coordinating keyway (not shown) positioned parallel to the longitudinal axis 66 thereby preventing relative rotational movement of the shroud 70 with respect to the torch delivery tube 54 and the spray nozzle 60 while allowing relative axial movement between the shroud 70, the torch delivery tube 54, and the spray nozzle 60.

One example of the metal spraying shroud assembly 50 includes a drive mechanism 106 which selectively moves the shroud 70 along the longitudinal axis 66 relative to the torch delivery tube 54 and the spray nozzle 60. The drive mechanism 106 includes a stepper motor 110 engaged with a drive shaft 116 preferably in the form of a worm drive or gear, a threaded receiver block 120 threadably engaged with the drive shaft 116, and a guide or timing peg 124 extending parallel to the drive shaft 116, as generally shown. The stepper motor 110 is stationarily mounted to a non-rotating portion of the metal spraying torch assembly 40 but moves with the metal spraying torch assembly as directed by the programmed robot 36. The stepper motor 110 is in electrical communication with a power source and a programmable controller (both not shown) to actuate and control the movement of the drive mechanism 106, as further described below.

The receiver block 120 includes a pair of roller guides or rollers 130 abuttingly positioned and rollably engaged with opposing surfaces of an annular flange 82 of the shroud 70, as generally shown. The roller guides 130 transfer selected linear movement of the receiver block 120 by the drive mechanism 106 to the shroud 70 along the longitudinal axis 66 while permitting rotation of the torch delivery tube 54, the spray nozzle 60, and the shroud 70 about the longitudinal axis 66. Other drive mechanisms 106, connections to and orientations with the metal spraying torch assembly 40, and the shroud 70 known by those skilled in the art may be used.

As best seen in FIGS. 3A and 3B, the shroud 70, through selected movement of the drive mechanism 106, includes a first position shown in FIG. 3A, wherein the spray opening 90 of the body 74 of the shroud 70 is not in axial alignment with the spray nozzle orifice 64, and a second position shown in FIG. 3B, wherein the spray opening 90 of the body 74 of the shroud 70 is axially aligned with the spray nozzle orifice 64 allowing a molten metal spray 68 to project toward the desired surface of the engine block workpiece 46, such as the inner cylindrical wall of the cylinder bore 48. As shown in FIG. 3A, under a condition where the metal spray 68 briefly continues through the spray nozzle orifice 64, the metal spray 68 is not to be directed toward the engine block workpiece 46. Thus, the first position of the shroud 70 aligns the spray deflector 94 and the deflection insert 100 with the spray nozzle orifice 64 to deflect the metal spray 68 away so that the metal spray 68 does not adhere to an undesired portion of the engine block workpiece 46 and is preferably drawn away by the particle vacuum system 30, shown in FIGS. 1, 9, and 10.

As best seen in FIGS. 2 and 4, one example of the metal spraying shroud assembly 50 includes an outer mask 140, as generally shown. The outer mask 140 includes a first end 146 positioned toward the first end 80 of the shroud 70, and a second end 150 positioned opposite from the first end 146, including a radially extending annular flange 156 for selectively abutting a surrounding engagement with the engine cylinder bore 48. The outer mask 140 includes a tubular body 160 concentrically positioned around a portion of the shroud body 74 and includes an axially expansible portion 166 positioned between the first end 146 and the free second end 150 of the shroud 70. The first end 146 is connected to the receiver block 120 through a bracket 170. The expansible portion 166 may be in the form of an axially expansible and compressible bellows having a plurality of convolutes made from a flexible, but durable material known by those skilled in the art. The remaining portions of outer mask 140 are made from a lightweight, rigid material to hold its concentric position about the shroud body 74. In the example illustrated, on movement of the drive mechanism 106, both the shroud 70 and the outer mask 140 linearly move together along the longitudinal axis 66. The outer mask 140, however, remains rotationally stationary while allowing the torch spray nozzle 60 and the shroud 70 to freely rotate about the longitudinal axis 66.

Figure 6A:
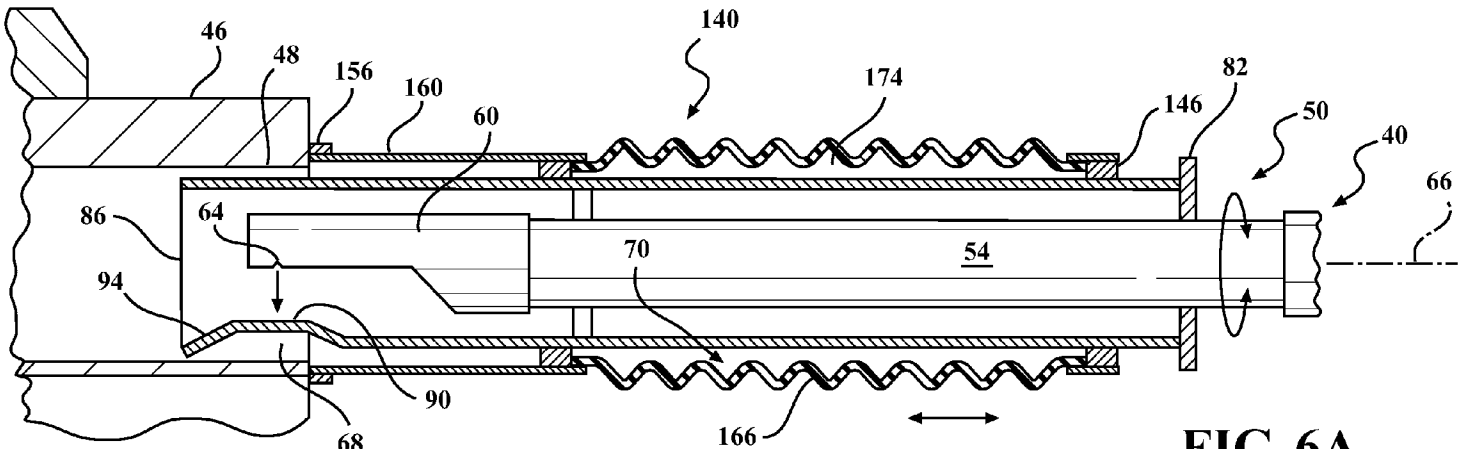
FIG. 6A is an alternate sectional view taken along line 5-5 in FIG. 5A with the shroud positioned in a second position and an outer mask engaging the workpiece of the thermal metal spraying apparatus of the present invention.

As best illustrated in FIG. 6A, the metal spraying shroud assembly 50 has a radial distance between the concentrically oriented shroud 70 and the outer mask 140 which defines an air flow passageway 174 from the first end 146 of the outer mask 140 through to the second end 150 of the outer mask 140, as generally shown. In the example, the air flow passageway 174 is placed in communication with the forced air device 26 to selectively force air through the air flow passageway 174 to create a positive air flow and pressure to move unadhered metal spray particles 68 and other debris away from the engine block workpiece 46 and into the particle vacuum system 30, which further aids the process.

Figure 5A:
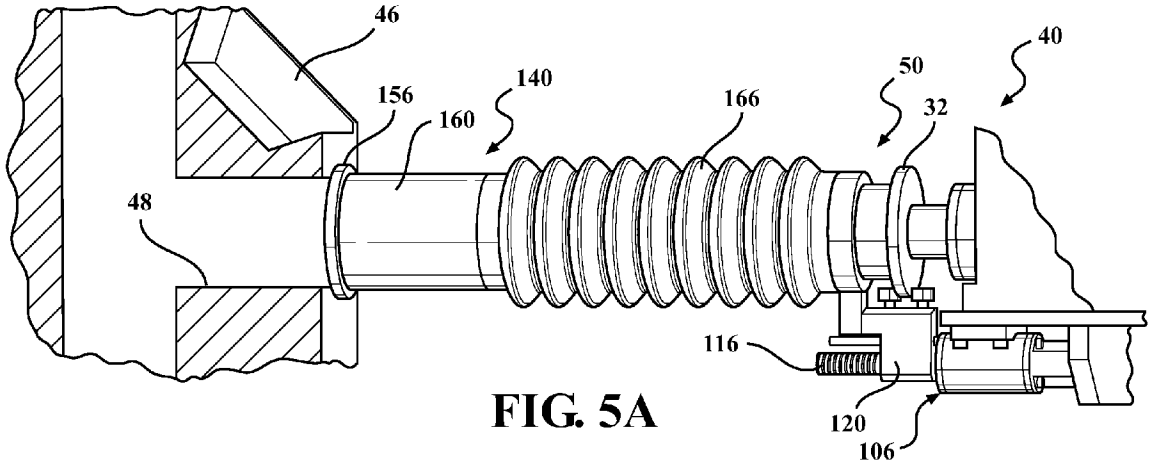
FIG. 5A is a perspective view of the metal spraying shroud assembly of the present invention in the first position and the metal spraying torch assembly positioned just prior to entering the workpiece.

Referring to FIGS. 5A-8B, an exemplary process and movement of the metal spray torch assembly 40 and the metal spraying shroud assembly 50 for use with an exemplary engine block workpiece 46 is illustrated and described. Referring to FIGS. 5A and 5B, on initiation of a thermal spraying process in processing cell 16, the robot 36 positions the metal spray torch assembly 40 and the metal spraying shroud assembly 50 in axial alignment with an axial center of the engine cylinder bore 48. In a typical start-up operation, the shroud 70 will be in its first position where the spray opening 90 is not aligned with spray nozzle orifice 64 and is preferably aligned with the spray deflector 94, as best seen in FIG. 5B. FIGS. 5A and 5C show the position of the drive mechanism 106 with the receiver block 120 in a retracted or non-extended position along the drive shaft 116. On the initial positioning of metal spray torch assembly 40 and the spray nozzle 60 at the entrance to the engine cylinder bore 48, the outer mask 140 is in a fully extended or non-compressed state, as shown in FIG. 5A, when the annular flange 156 is placed in abutting contact with the engine block workpiece 46 concentrically around the engine cylinder bore 48.

Figure 5B:
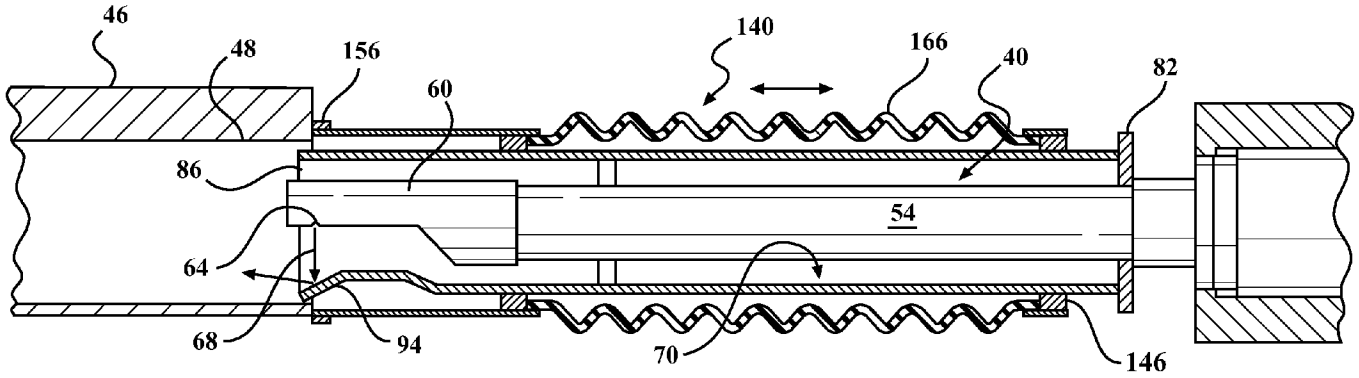
FIG. 5B is a section taken along lines 5-5 in FIG. 5A of the thermal metal spraying apparatus of the present invention.
Figure 5C:
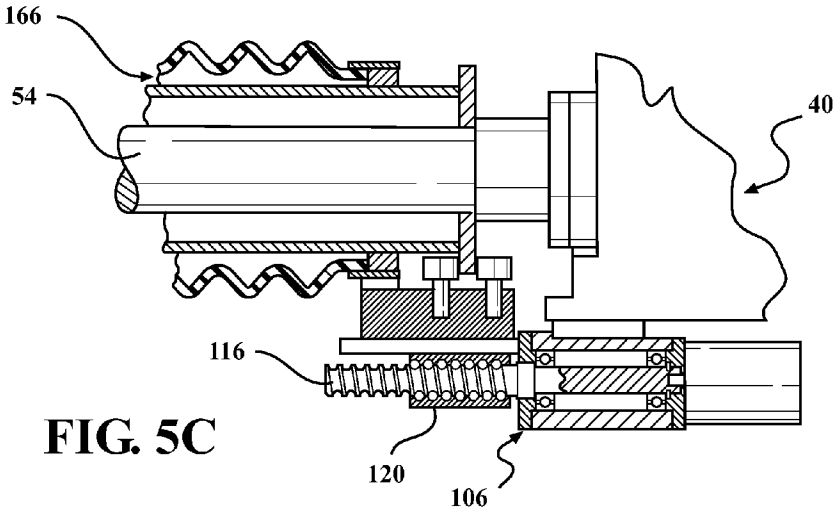
FIG. 5C is a partial sectional view showing a drive mechanism positioning the shroud in the first position in FIG. 5A of the thermal metal spraying apparatus of the present invention.

In a typical application for spraying the interior surface of the cylinder bore 48 and to ensure that the metal spray 68 is applied to the very top of the engine cylinder bore 48, the spray nozzle 60 and the spray nozzle orifice 64 are aligned with the very top surface or edge of the inner cylinder bore 48, as best seen in FIG. 5B. With the shroud 70 positioned in the first position preventing metal spray 68 toward the engine block workpiece 46, any metal spray 68 that exits the spray nozzle orifice 64 is directed away until it is desired to direct the metal spray 68 toward the engine block workpiece 46. At this point, the outer mask 140 ensures that no metal spray 68 is allowed to project out of the cylinder bore 48 to undesired areas on top of the engine block workpiece 46.

Figure 6B:
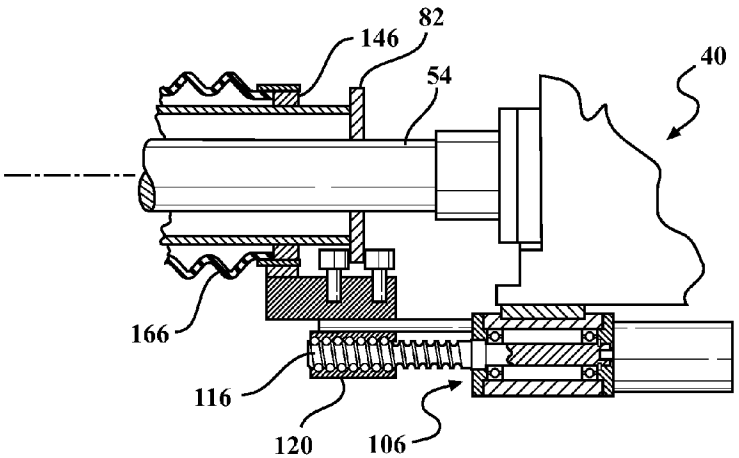
FIG. 6B is a partial sectional view showing the drive mechanism positioning the shroud in a second position in FIG. 6A of the thermal metal spraying apparatus of the present invention.

Referring to FIGS. 6A and 6B, once it is determined through a controller or other process checks (not shown) that the metal spray torch assembly 40 is correctly positioned and the spraying of metal through the spray nozzle orifice 64 has commenced, the drive mechanism 106 is activated to translate the shroud 70 to its second position whereby the spray opening 90 is axially aligned with the spray nozzle orifice 64 allowing the metal spray 68 to propel toward the desired engine cylinder bore 48 to receive the metal spray 68. FIG. 6B shows the position of the drive mechanism 106 and the receiver block 120 when the shroud 70 is in the second, "mask open" position. As shown, the optional air flow passageway 174 through the outer mask 140 may be activated and operated, as generally described above.

Figure 7A:
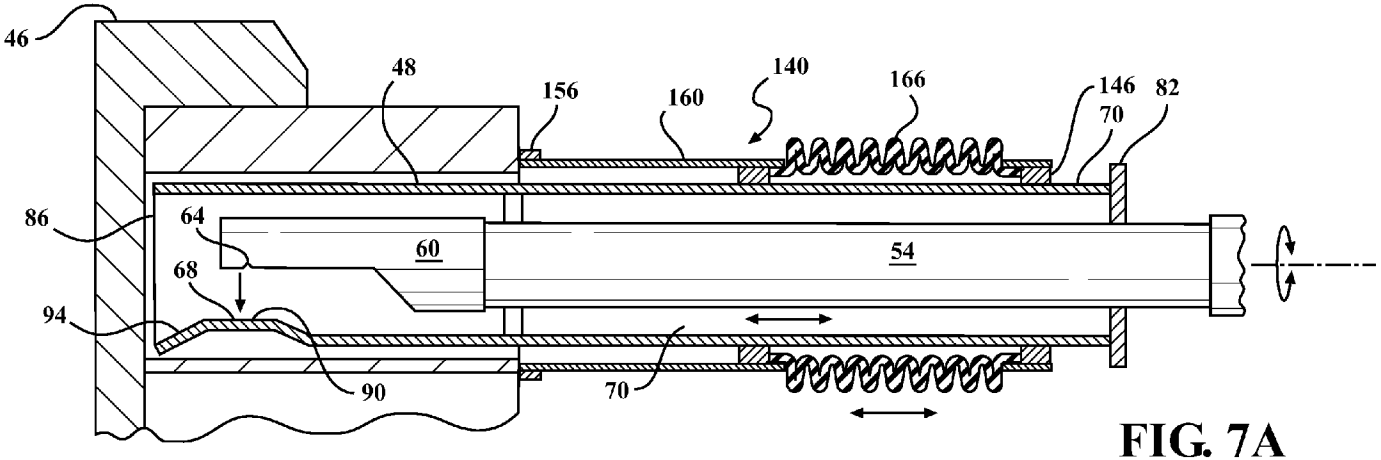
FIG. 7A is an alternate sectional view taken along line 5-5 in FIG. 5A with the metal spray torch assembly positioned deep in the workpiece and the shroud in a second position of the thermal metal spraying apparatus of the present invention.
Figure 7B:
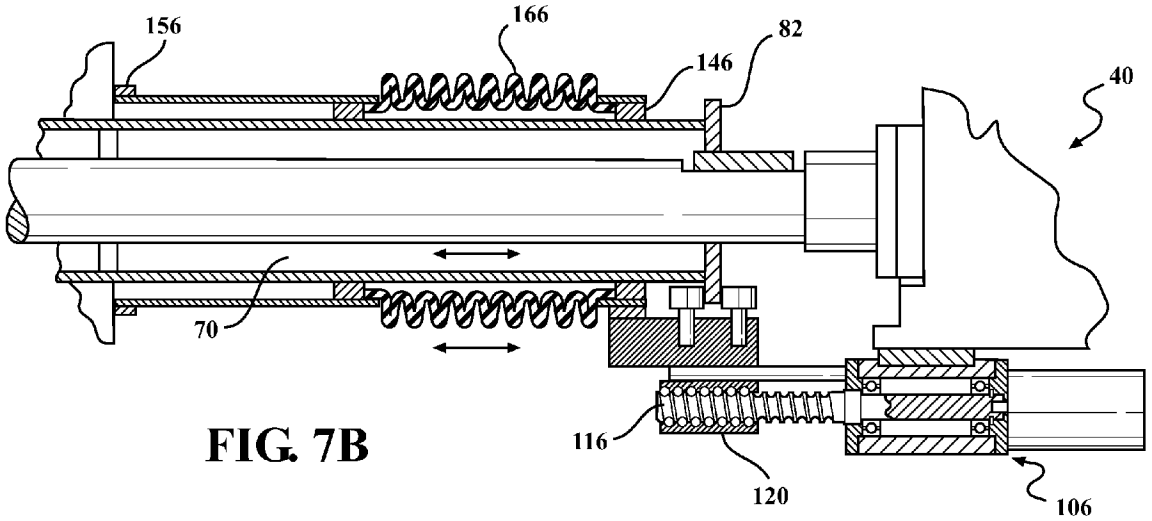
FIG. 7B is a partial sectional view showing the drive mechanism positioning the shroud in a second position shown in FIG. 7A of the thermal metal spraying apparatus of the present invention.

Referring to FIGS. 7A and 7B, with the shroud 70 in the second or "mask open" position allowing the metal spray 68 to project toward the desired surface to be coated, thermal spraying of the exemplary engine cylinder bore 48 continues with the torch spray nozzle 60 and the shroud 70 rotating about the longitudinal axis 66 and further linearly translated along the longitudinal axis 66 by the robot 36 to coat the desired surface of the engine cylinder bore 48. As the spray nozzle 60 moves axially deeper into the engine cylinder bore 48, the expansible portion 166 of the outer mask 140 begins to compress to allow for linear movement while maintaining the annular flange 156 in an abutting engagement with the engine block workpiece 46.

Figure 8A:
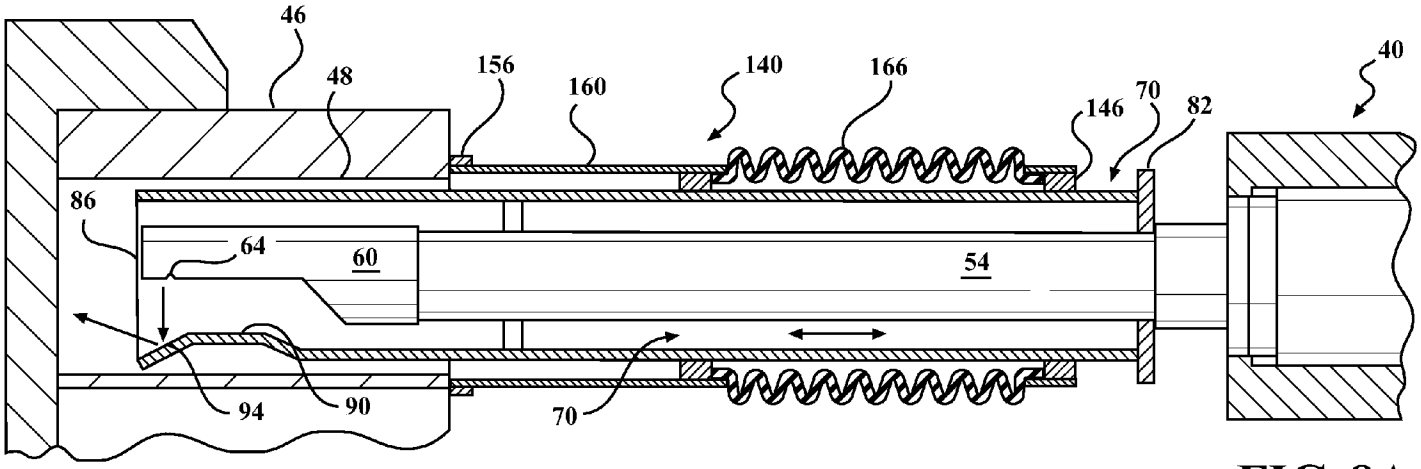
FIG. 8A is an alternate view of FIG. 7A with the shroud in the first position and the outer mask engaged with the workpiece of the thermal metal spraying apparatus of the present invention.
Figure 8B:
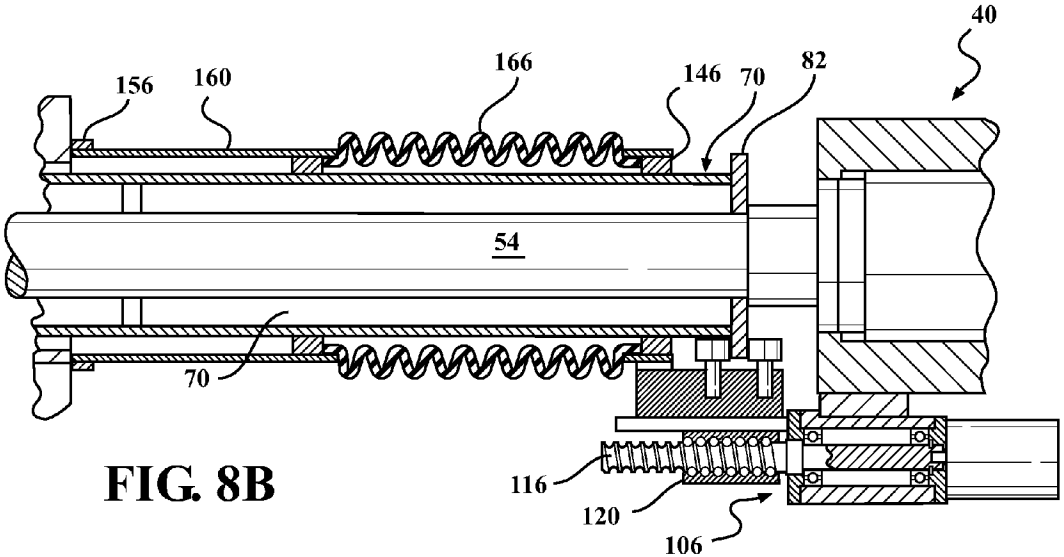
FIG. 8B is a partial sectional view showing the drive mechanism positioning the shroud in a first position shown in FIG. 8A of the thermal metal spraying apparatus of the present invention.
Figure 9:
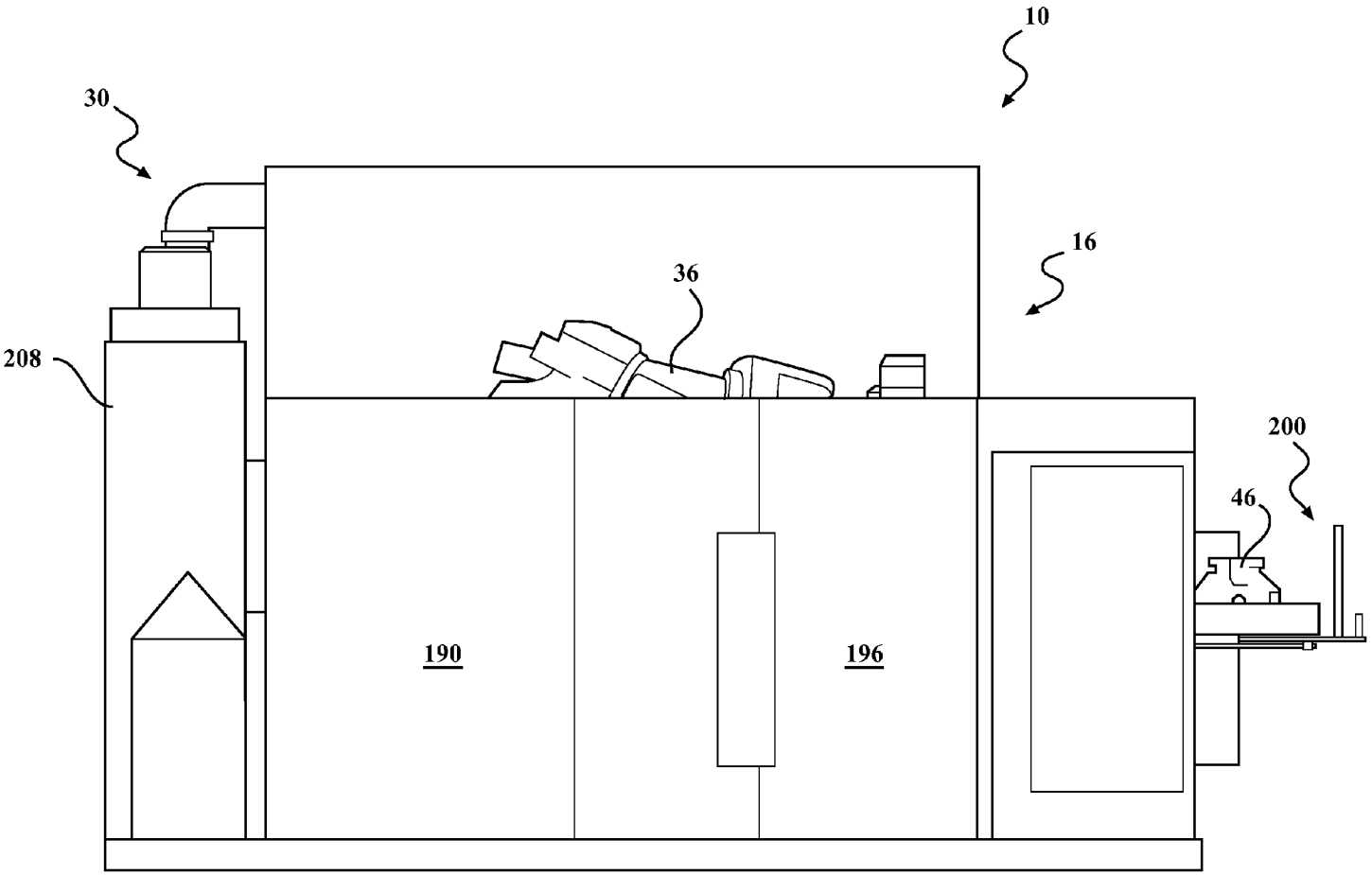
FIG. 9 is a side view of the processing cell of the thermal metal spraying apparatus of the present invention shown in FIG. 1.

Referring to FIGS. 8A and 8B, once the metal spraying torch assembly 40 and the spray nozzle 60 have coated the desired surface of the engine cylinder bore 48 and approach the open bottom end of the engine cylinder bore 48, it is desired to spray right up to the edge of the bottom of the engine cylinder bore 48 and minimize overspray into undesired areas immediately adjacent the bottom edge of the engine cylinder bore 48. At this position, the drive mechanism 106 is actuated and reversed to quickly move the shroud 70 back to the first position so that the spray opening 90 is no longer aligned with the spray nozzle orifice 64 thereby again deflecting any continued metal spray 68 off deflection insert 100, as generally described above. Use of the metal spraying shroud assembly 50 to prevent over spraying of the metal spray 68 on undesired surfaces at the top and bottom of the engine cylinder bore 48 is highly advantageous over prior masking devices. Where multiple passes of the spray nozzle 60 occur to achieve the desired thickness of the metal coating, the shroud 70 and the drive mechanism 106 are cycled in the described manner to accommodate the thermal or plasma metal spraying process.

Figure 10:
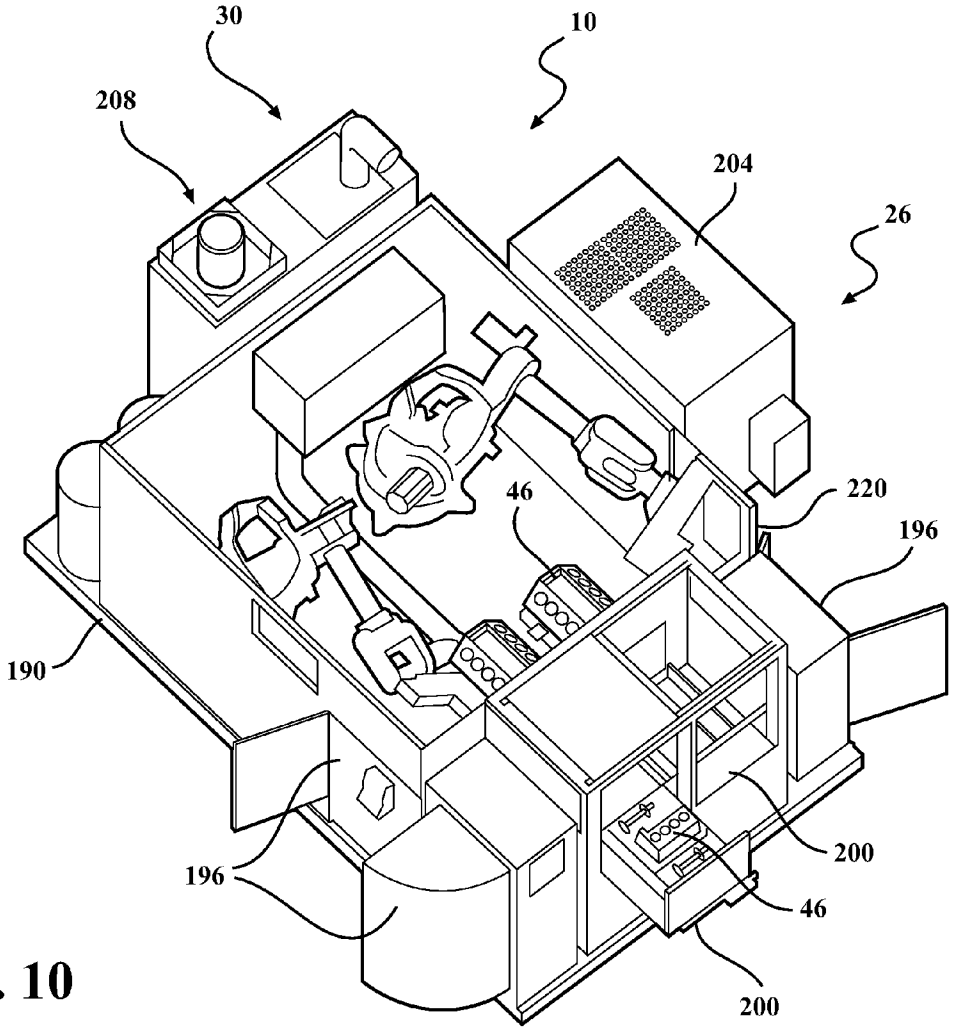
FIG. 10 is a schematic perspective view of the processing cell shown in FIG. 1 of the thermal metal spraying apparatus of the present invention.

Referring to FIGS. 1 and 9-12, an example of the processing cell 16 and process for using the metal spraying torch assembly 40 and the metal spraying shroud assembly 50 is illustrated and disclosed. The processing cell 16 may include an enclosure or fence 190 which encompasses the work or process area where the robots 36 are positioned along with fixtures to secure and position the engine block workpieces 46 to receive the thermal metal spray 68, as described above. The enclosure 190 may include one or more control panels 196 for the robots 36 and other powered, controlled or monitored systems in the processing cell 16, for example, the metal spraying torch assembly 40. As best seen in FIG. 10, the forced air device 26 may include a compressor 204 in fluid communication with the processing cell 16 and the air flow passageway 174, illustrated in FIG. 6B and described above. The processing cell 16 may include a particle vacuum system 30 which may further include a system of conduits extending to the area where the thermal spraying occurs and which may connect to a filter system 208 to filter and recirculate the air to the processing cell 16 or back to the compressor 204 in a substantially closed-loop system. Other cell components, structures and configurations known by those skilled in the art may be used.

The processing cell 16 may include the workpiece delivery system 20 having one or more workpiece drawers 200 that operate to support and translate the engine block workpieces 46 into and out of the processing cell 16. In one example, the drawers 200 extend outward from the processing cell 16 permitting one or more of the engine block workpieces 46 to be loaded onto the drawer 200 including appropriate fixtures to support and secure the engine block workpiece 46. The drawer 200 is translated into the processing cell 16 for the engine block workpiece 46 to be thermally sprayed. The engine block workpiece 46 may remain supported by the drawer 200 during the thermal spraying process or displaced onto separate fixtures in the processing cell 16 by the robot 36 or other means (not shown). As shown in the example shown in FIG. 10, overhead access to the drawers 200 may be provided for a gantry-type crane or hoist (not shown) to load the engine block workpieces 46 onto the drawer 200 from above to suit that particular engine block workpiece 46 and process.

Figure 11:
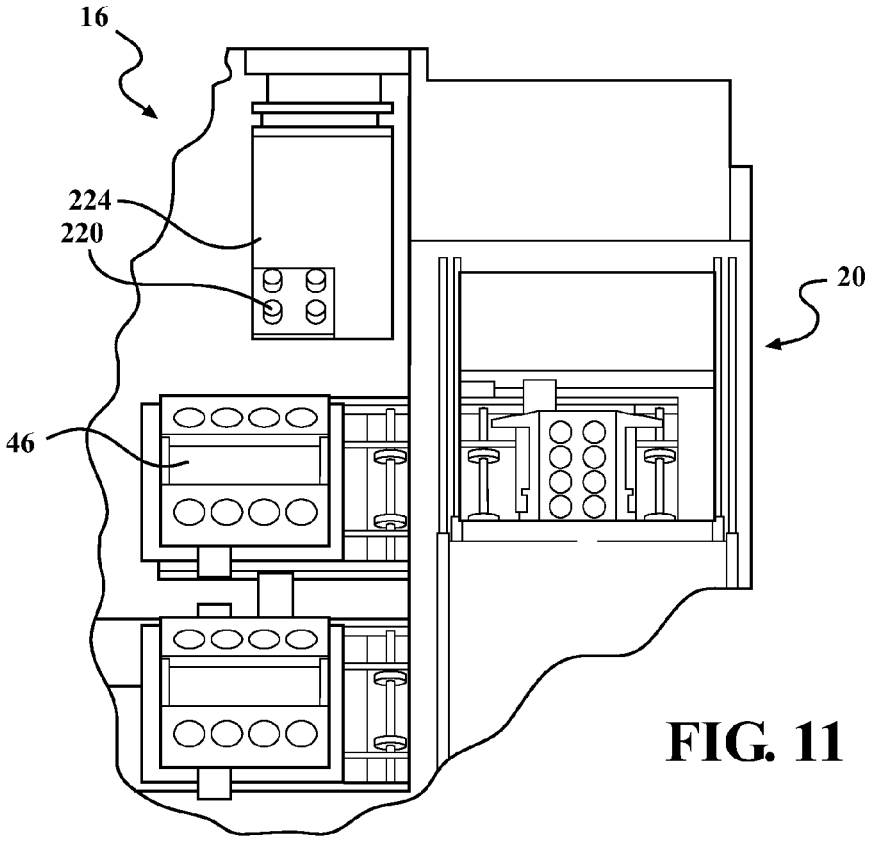
FIG. 11 is a partial perspective view of the processing cell in FIG. 9 showing a tool changer of the thermal metal spraying apparatus of the present invention.
Figure 12:
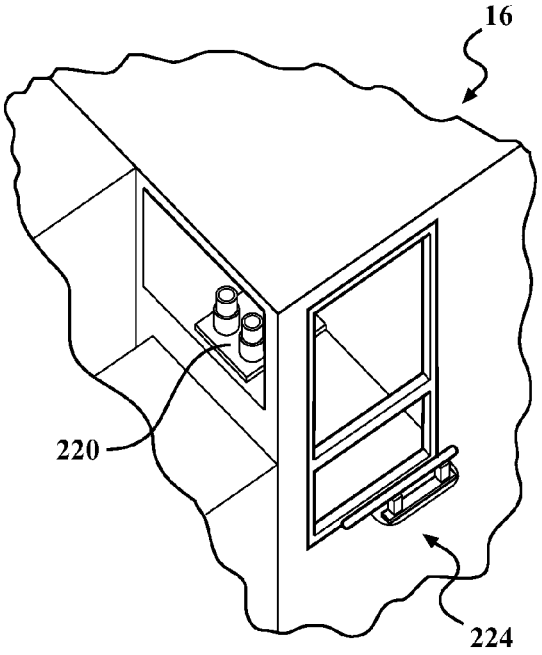
FIG. 12 is a partial perspective view of the processing cell in FIG. 1 showing the tool changer in FIG. 11 of the thermal metal spraying apparatus of the present invention.

In the processing cell 16 shown in FIGS. 10-12, a tool change device 220 in the exemplary form of a tool change drawer 224 is illustrated. In one example, multiple metal spraying shroud assemblies 50 may be positioned and oriented on the tool change drawer 224 within reach and access of one or more of the robots 36 to permit quick changing of the metal spraying shroud assembly 50 from the metal spraying torch assembly 40 to accommodate changes in the type or configuration of the engine block workpiece 46, to clean or recondition a used metal spraying shroud assembly 50 or other reasons known by those skilled in the art. It is contemplated that the shroud 70 is configured to be easily and quickly disconnected from the metal spraying torch assembly 40 through manual or semi-automatic means for rapid changeover between shrouds 70.

It is further contemplated that the metal spraying torch assembly 40 and the metal spraying shroud assembly 50 is, as a unit, quickly and easily disconnected from the robot 36 and positioned on the tool change drawer or fixture 224 for similar reasons of a workpiece 46 changeover, reconditioning of the metal spraying torch assembly 40 or metal spraying shroud assembly 50 and other reasons known by those skilled in the art. This may be accomplished by a quick change connector or coupling (not shown) which connects the metal spraying torch assembly 40 to the robot 36. Motorized and articulating mechanical engagement clamping or securing devices (not shown) on the robot 36 tooling mounting plate (not shown) may be selectively cycled to "grab" or engage and disengage the metal spraying torch assembly 40 and/or the shroud 70 to the robot 36 so as to allow for "quick-change" type connecting or coupling.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A thermal metal spraying apparatus having a thermal metal spraying torch for applying a metal coating to a workpiece through a torch spraying nozzle having a spraying orifice, comprising:

a substantially tubular shroud having a first end and a second end and adaptable to concentrically receive said torch spraying nozzle, and said shroud having an opening adjacent to said second end through a cylindrical surface of said shroud, wherein said opening is selectably alignable with said spraying orifice; and a drive mechanism connected to said shroud and operable to translate said shroud between a first position, wherein said opening of said shroud is not aligned with said spraying orifice preventing spraying of said metal coating on said workpiece, and a second position, wherein said opening of said shroud is aligned with said spraying orifice permitting the spraying of said metal coating toward said workpiece and said spraying orifice remains at least partially within said shroud.

2. The thermal metal spraying apparatus as stated in claim 1, further comprising:

a deflection insert connected to said second end of said shroud adjacent said opening for deflecting said metal coating away from said workpiece when said shroud is in said first position.

3. The thermal metal spraying apparatus as stated in claim 2, further comprising:

said deflection insert positioned at an acute angle relative to a longitudinal axis of said shroud.

4. A thermal metal spraying apparatus having a thermal metal spraying torch for applying a metal coating to a workpiece through a torch spraying nozzle having a spraying orifice, comprising:

a substantially tubular shroud having a first end and a second end and adaptable to concentrically receive said torch spraying nozzle, and said shroud having an opening at said second end, wherein said opening is selectably alignable with said spraying orifice; and a drive mechanism connected to said shroud and operable to translate said shroud between a first position, wherein said opening of said second end is not aligned with said spraying orifice preventing spraying of said metal coating on said workpiece, and a second position, wherein said opening of said second end is aligned with said spraying orifice permitting the spraying of said metal coating toward said workpiece, wherein said shroud has a mechanical spline formed on an inner diameter at said first end of said shroud, and said mechanical spline engageable with a mating spline on said torch spraying nozzle for allowing linear movement of said shroud relative to said torch spraying nozzle along a longitudinal axis of said shroud and preventing rotational movement of said shroud relative to said torch spraying nozzle.

5. The thermal metal spraying apparatus as stated in claim 4, further comprising:

said drive mechanism having a motor connectable to said torch spraying nozzle and having a threaded drive shaft extending from said motor; and a receiver block connected to said first end of said shroud and having a threaded aperture for threadably receiving said drive shaft, wherein said motor drives linear movement of said shroud relative to said torch spraying nozzle along said longitudinal axis of said shroud by rotating said drive shaft within said threaded aperture of said receiver block.

6. The thermal metal spraying apparatus as stated in claim 1, further comprising:

a substantially tubular outer mask for receiving said shroud in a substantially concentric matter;

a longitudinal passageway formed between said outer mask and said shroud; and a pressurized air source in communication with said passageway for selectively directing said metal coating away from said workpiece through application of pressurized air.

7. The thermal metal spraying apparatus as stated in claim 6, further comprising:

an adjustment mechanism connected to said outer mask for changing a longitudinal length of said outer mask relative to said shroud.

8. The thermal metal spraying apparatus as stated in claim 7, further comprising:

said adjustment mechanism having a flexible bellows portion connected to said outer mask for contracting and expanding the longitudinal length of said outer mask.

9. A thermal metal spraying apparatus having a thermal metal spraying torch for applying a metal coating to a workpiece through a torch spraying nozzle having a spraying orifice, comprising:

a substantially tubular shroud having a first end and a second end and adaptable to concentrically receive said torch spraying nozzle, and said shroud having an opening of said second end, wherein said opening is selectably alignable with said spraying orifice;

a drive mechanism connected to said shroud and operable to translate said shroud between a first position, wherein said opening of said second end is not aligned with said spraying orifice preventing spraying of said metal coating on said workpiece, and a second position, wherein said opening at said second end is aligned with said spraying orifice permitting the spraying of said metal coating toward said workpiece, a substantially tubular outer mask for receiving said shroud in a substantially concentric matter;

a longitudinal passageway formed between said outer mask and said shroud; and a pressurized air source in communication with said passageway for selectively directing said metal coating away from said workpiece through application of pressurized air, wherein said shroud has a mechanical spline formed on an inner diameter at said first end of said shroud, and said mechanical spline engageable with a mating spline on said torch spraying nozzle for providing linear movement of said shroud relative to said torch spraying nozzle along a longitudinal axis of said shroud and preventing rotational movement of said shroud relative to said torch spraying nozzle.

10. The thermal metal spraying apparatus as stated in claim 9, further comprising:

said drive mechanism having a motor connectable to said torch spraying nozzle and having a threaded drive shaft extended from said motor; and a receiver block connected to said outer mask, and said receiver block having a threaded aperture for threadably receiving said drive shaft, wherein said motor drives linear movement of said shroud relative to said torch spraying nozzle along said longitudinal axis of said shroud by rotating said drive shaft.

11. The thermal metal spraying apparatus as stated in claim 10, further comprising:

a pair of opposing rollers rotatably connected to said receiver block and rollably engaging said shroud to provide rotational movement of said outer mask relative to said shroud and to provide linear movement of said shroud relative to said torch spraying nozzle.

12. The thermal metal spraying apparatus as stated in claim 6, further comprising:

a vacuum system for vacuuming said metal coating that is unadhered to said workpiece.

13. The thermal metal spraying apparatus stated in claim 1, further comprising:

a manipulator connected to said shroud and connectable to said torch spraying nozzle for properly positioning said shroud and said torch spraying nozzle relative to said workpiece.

14. The thermal metal spraying apparatus as stated in claim 13, further comprising:

a processing cell for enclosing said manipulator, said torch spraying nozzle, said shroud, and said workpiece.

15. The thermal metal spraying apparatus as stated in claim 14, wherein said processing cell further comprises:

a workpiece delivery system having a retractable drawer that moves between an open position, wherein said drawer moves outside said processing cell for loading and unloading said workpiece, and a closed position, wherein said drawer moves inside said processing cell, allowing said metal coating to be sprayed on said workpiece.

16. The thermal metal spraying apparatus as stated in claim 14, wherein said processing cell further comprises:

an automatic tool changing system having a retractable drawer that moves between an open position, wherein said drawer moves outside of said processing cell for loading and unloading at least one alternative metal spraying torch, and a closed position, wherein said drawer moves inside said processing cell allowing said at least one alternative spraying torch to be accessed by said manipulator.

17. The thermal metal spraying apparatus stated in claim 16, further comprising:

an automatic tool changer connected to said manipulator for engaging and disengaging said torch spraying nozzle.

18. The thermal metal spraying apparatus as stated in claim 14, further comprising:

a vacuum system disposed within said processing cell for collecting said metal coating that does not adhere to said workpiece.

19. The thermal metal spraying apparatus as stated in claim 15, further comprising:

said retractable drawer having a workpiece holding fixture disposed therein and adaptable for receiving said workpiece to allow said metal coating to be applied to said workpiece while said workpiece is disposed within said workpiece holding fixture.

* * * * *